US005935023A

United States Patent [19]

Maehara et al.

[11] Patent Number: 5,935,023

[45] Date of Patent: Aug. 10, 1999

[54] GOLF BALL

[75] Inventors: Kazuto Maehara; Keisuke Ihara; Hirotaka Shimosaka; Michio Inoue; Atsuki Kasashima, all of Chichibu, Japan

[73] Assignee: Bridgestone Sports Co., Ltd., Tokyo, Japan

[21] Appl. No.: 08/989,634

[22] Filed: Dec. 12, 1997

[30] Foreign Application Priority Data

Dec. 17, 1996 [JP] Japan ..... 8-353634

[51] Int. Cl.[6] ..... A63B 37/14

[52] U.S. Cl. ..... 473/384; 473/379

[58] Field of Search ..... 473/384, 379

[56] References Cited

U.S. PATENT DOCUMENTS 878,254 2/1908 Taylor ..... 473/384

5,080,367 1/1992 Lynch et al. ..... 473/384

5,569,100 10/1996 Molitor et al. ..... 473/384

*Primary Examiner*—George J. Marlo

*Attorney, Agent, or Firm*—Sughrue, Mion, Zinn, Macpeak & Seas, PLLC

[57] ABSTRACT

A golf ball having a plurality of dimples on its surface, the dimples including dimples which are different in diameter and/or depth, the total number of dimples is 392 to 432, and the golf ball has a percent dimple surface area occupation of 77 to 82%, a percent dimple volume occupation of 0.85 to 1.2%, an average dimple diameter of 2.5 to 4.5 mm (0.098 to 0.177 inches), an average dimple depth of 0.12 to 0.18 mm (0.005 to 0.007 inches), an average dimple $V_0$ value of 0.4 to 0.6, and a dimple edge angle of 4.0 to 17.0 degrees, where CL is a lift coefficient and CD is a drag coefficient, CL is in the range of 0.140 to 0.190, CD is in the range of 0.21 to 0.255, and CL/CD is in the range of 0.640 to 0.730 when the ball is in flight at a velocity of 65 m/s and a spin rate of 42 rps.

11 Claims, 4 Drawing Sheets

ALGORITHM FOR THE ANALYSIS OF LIFT AND DRAG COEFFICIENTS

GOLF BALL

BACKGROUND OF THE INVENTION

1. Field of the Invention

This invention relates to a dimpled golf ball having improved aerodynamics and flight distance.

2. Prior Art

As the golf becomes more popular and the golfer population increases, more diversified demands are imposed on golf balls. In general, golf balls are desired to travel a long distance.

A variety of proposals have been made on golf balls for increasing the flight distance. Many such proposals are to modify the dimpled surface for adding to the flight distance. Most prior proposals relate to the arrangement and structure of dimples while few investigations have been made from the standpoint of lift and drag coefficients When the flight distance is increased, it is not known whether the ball travels that distance due to an increased lift or a reduced drag. In most balls, the balance of lift and drag is not optimized.

SUMMARY OF THE INVENTION

An object of the invention is to provide a golf ball having an appropriate balance of lift and drag so that the ball offers an increased flight distance and run as well as decreased wind resistance.

The inventors have found that this and other objects are achieved by properly determining a first term $CL_1$ of a lift coefficient and a first term $CD_1$ of a drag coefficient in the lift and drag function model shown below and that an added distance is accomplished by properly determining a lift coefficient CL and a drag coefficient CD of a ball in flight under typical initial conditions given when struck with a wood club #1 or driver at a head speed of 45 m/s, that is, at a velocity of 65 m/s and a spin rate of 42 rps.

In a first aspect, the present invention provides a golf ball having a plurality of dimples on its surface wherein a first term of a lift coefficient $CL_1$ and a first term of a drag coefficient $CD_1$ satisfy that $CD_1$ is in the range of 0.175 to 0.220, $CL_1/CD_1$ is in the range of 2.60 to 3.30, and $CL_1 \times CD_1$ is in the range of 0.110 to 0.145.

In a second aspect, the present invention provides a golf ball having a plurality of dimples on its surface wherein provided that CL stands for a lift coefficient and CD stands for a drag coefficient, CL is in the range of 0.140 to 0.190, CD is in the range of 0.210 to 0.255, and CL/CD is in the range of 0.640 to 0.730 when the ball is in flight at a velocity of 65 m/s and a spin rate of 42 rps.

DETAILED DESCRIPTION OF THE INVENTION

Figure 1:
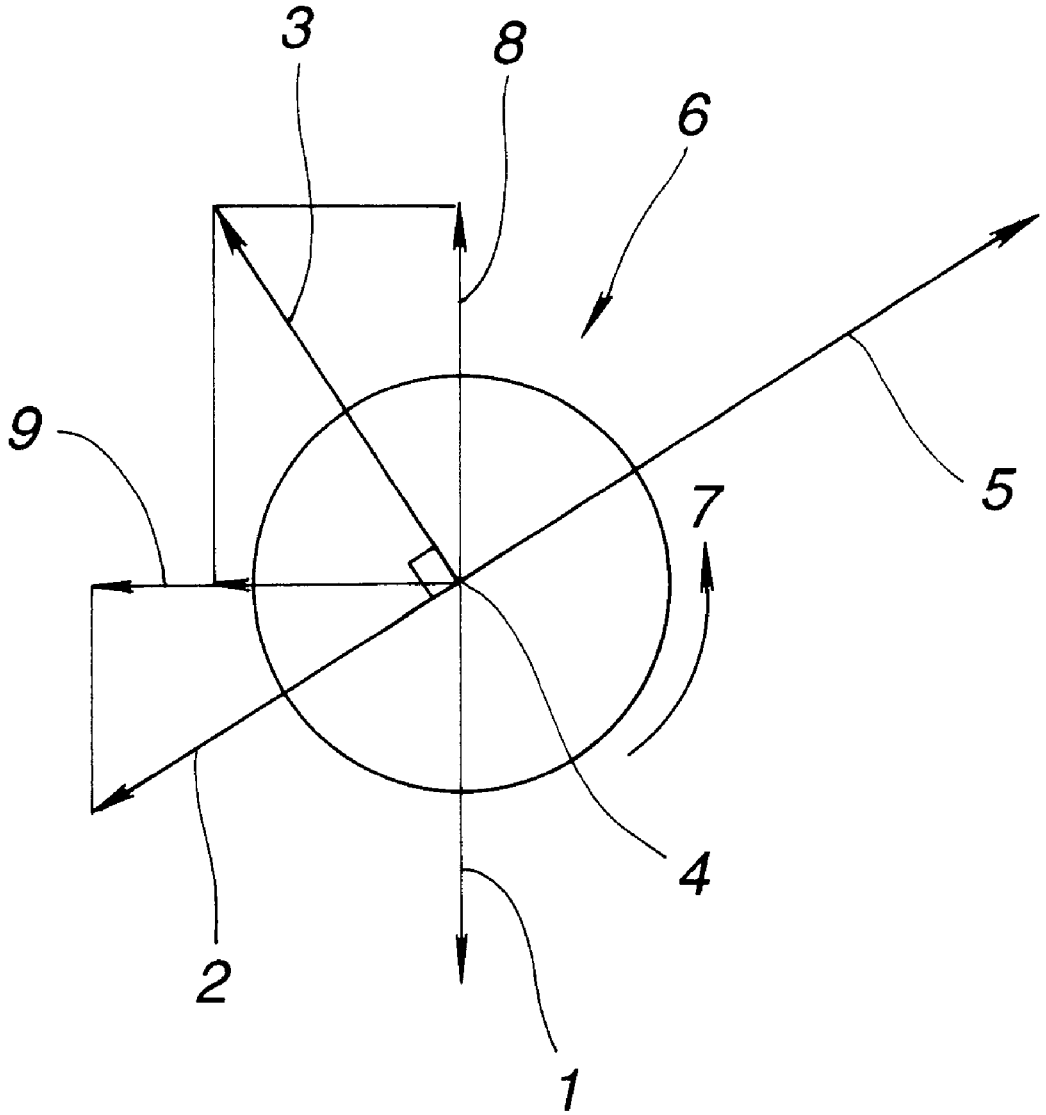
FIG. 1 shows a golf ball in flight illustrating the lift and drag acting thereon.

Referring to FIG. 1, there is illustrated a golf ball in flight. When the golf ball 6 having a center 4 moves in a direction 5 and spins in a direction 7, forces acting on this ball in flight include the force of gravity 1, air resistance or drag 2, a lift 3 produced by Magnus's effect associated with spin.

The force acting on the golf ball is represented by the following trajectory equation (1).

$$F=FL+FD+Mg \tag{1}$$

F: force acting on the golf ball

FL: lift

FD: drag

Mg: gravity

The lift FL and drag FD in the trajectory equation (1) are represented by the following equations (2) and (3).

$$FL=0.5\times CL\times\rho\times A\times V^2 \tag{2}$$

$$FD=0.5\times CD\times\rho\times A\times V^2 \tag{3}$$

CL: lift coefficient

CD: drag coefficient

ρ: air density

A: golf ball maximum cross-sectional area

V: golf ball airspeed

Through numerous measurements of golf ball trajectories, the inventors have found that the lift coefficient CL and drag coefficient CD are represented by the following equations (4) to (6).

$$W=r\times\omega/V \tag{4}$$

$$CL=(CL_1+CL_2\times W)\times\sqrt{W} \tag{5}$$

$$CD=CD_1+CD_2\times W \tag{6}$$

W: spin rate ratio r: golf ball radius (m)

ω: golf ball rotation angular velocity (rad/sec.)

$CL_1$: a first term of the lift coefficient $CL_2$: a second term of the lift coefficient $CD_1$: a first term of the drag coefficient $CD_2$: a second term of the drag coefficient The inventors have found that a good balance of lift and drag is achieved when the first term of the lift coefficient $CL_1$ and the first term of the drag coefficient $CD_1$ satisfy the range and relationship that $CD_1$ is from 0.175 to 0.220, $CL_1/CD_1$ is from 2.60 to 3.30, and $CL_1\times CD_1$ is from 0.110 to 0.145. Then an increased flight distance is expectable.

Once lift and drag function coefficients $CL_1$, $CL_2$ and $CD_1$, $CD_2$ have been determined in this way, the lift and drag coefficients CL and CD under any conditions of ball velocity and spin rate in the actual play region can be determined, that is, the aerodynamics of dimples can be evaluated.

Nevertheless, the relationship between lift and drag of the golf ball in flight cannot be interpreted by a simple description. Actually, the greater the lift, the greater becomes the drag. For an added distance, it is important to find an appropriate balance between lift and drag while reducing the drag as low as possible.

The flight distance can be increased when the ball receives a greater lift FL (lift coefficient CL) and a smaller drag FD (drag coefficient CD). Since the lift 3 acts in a direction perpendicular to the moving direction 5 of the ball as shown in FIG. 1, the lift 3 is divided into a vertical component 8 for drawing the ball upward and a horizontal component 9 for drawing the ball backward. The backward drawing force 9 is added to the drag 2. Then, as the lift becomes greater and as the angle of launching the ball (loft angle) also increases, the drag becomes greater. Furthermore, for the reasons that it is difficult to change either one of the lift and drag coefficients CL and CD since they have a highly positive correlation and that the airspeed V and the spin rate of the ball change with the lapse of flight time, CL and CD cannot be recognized as constants. From these considerations, the inventors have found a lift and drag function model consisting of equations (4) to (6) for defining lift and drag coefficients CL and CD.

The inventors have further found that the intrinsic aerodynamics of a golf ball are represented by lift and drag coefficients $CL_1$, $CL_2$, $CD_1$, and $CD_2$ and that a golf ball offering an increased flight distance, wind resistance and good run is obtained by designing dimples to meet the above-mentioned range and relationship of $CL_1$ and $CD_1$. The first aspect of the invention is predicated on this finding.

Another problem is that the consistent and accurate determination of lift and drag coefficients is difficult because the mutual dependency between lift and drag coefficients is substantial so that the lift and drag coefficients change more or less by measurement errors Through further investigations, the inventors have found that when a spin/velocity ratio W is evaluated under typical initial conditions given when strucken with a wood club #1 or driver at a head speed of 45 m/s, that is, at a velocity of 65 m/s and a spin rate of 42 rps, the lift and drag coefficients can be consistently and accurately determined though partially or in fragments.

When the lift coefficient CL and the drag coefficient CD defined by equations (4) to (6) satisfies that CL is in the range of 0.140 to 0.190, CD is in the range of 0.210 to 0.255, and CL/CD is in the range of 0.640 to 0.730 when the ball is in flight at a velocity of 65 m/s and a spin rate of 42 rps, the ball receives a good balance of lift and drag and thus travels an addded distance. It is effective for increasing the flight distance that the lift/drag coefficient ratio CL/CD is as high as possible. The second aspect of the invention is predicated on this finding.

In summary, a golf ball offering an increased flight distance, wind resistance and good run is obtained when dimple design is made such that the lift and drag coefficients CL, CD, $CL_1$, $CD_1$, $CL_2$, and $CD_2$ involved in the lift and drag function model representing the aerodynamic properties of the ball may fall in specific ranges.

The invention is described in further detail.

When the lift and drag function model for defining lift and drag coefficients CL and CD consists of equations (4) to (6):

$$W=r\times\omega/V \tag{4}$$

$$CL=(CL_1+CL_2\times W)\times\sqrt{W} \tag{5}$$

$$CD=CD_1+CD_2\times W \tag{6}$$

as mentioned above, the golf ball according to the first aspect of the invention is characterized in that $CD_1$ is in the range of 0.175 to 0.220, preferably 0.185 to 0.210, $CL_1/CD_1$ is in the range of 2.60 to 3.30, preferably 2.70 to 3.20, and $CL_1\times CD_1$ is in the range of 0.110 to 0.145, preferably 0.115 to 0.135. If $CL_1$ and $CD_1$ are outside these ranges, the flight distance would be reduced. It is preferred in the above equations that $CL_2$ is in the range of −0.5 to 0.1 and $CD_2$ is in the range of 0.1 to 0.5.

The golf ball according to the second aspect of the invention is characterized in that the lift coefficient CL is in the range of 0.140 to 0.190, preferably 0.150 to 0.185, the drag coefficient CD is in the range of 0.210 to 0.255, preferably 0.220 to 0.250, and CL/CD is in the range of 0.640 to 0.730, preferably 0.645 to 0.710 when the ball is in flight at a velocity of 65 m/s and a spin rate of 42 rps, that is, under typical initial conditions assumed when strucken with a wood club #1 or driver at a head speed of 45 m/s. The flight distance is reduced when CL and CD are outside the above-defined ranges.

The lift and drag coefficients CL, CD, $CL_1$, $CL_2$, $CD_1$, and $CD_2$ are determined as follows. Using a hitting machine, initial conditions (initial velocity, spin and launch angle) and spatial coordinates of a golf ball trajectory are measured under plural sets of conditions covering the actual play region. The initial conditions cannot be fixed since they vary with head speed and other variants. The present invention is predicted on a ball velocity of 65 m/s and a spin rate of 42 rps as the typical initial conditions for the ball when struck at a head speed of 45 m/s and a launch angle of 10°.

Then, using the trajectory equation satisfying the above lift and drag function shape as an estimating function, and the several variable nonlinear least squares method capable of solving implicit representation, the lift and drag coefficients that minimize the sum of squares of errors between an observing position and a calculating position are determined.

The golf ball of the invention having a plurality of dimples on its surface which are designed such that lift and drag coefficients satisfy the above-defined range and relationship has the advantages of wind resistance, good run and increased flight distance. Preferably, the dimples formed on the ball surface include plural types of dimples which are different in diameter and/or depth, more preferably two to six types, most preferably three to five types of dimples. The total number of dimples is preferably 340 to 548, more preferably 392 to 432. An average dimple diameter is preferably 2.5 to 4.5 mm, more preferably 3 to 4 mm. An average dimple depth is preferably 0.10 to 0.22 mm, more preferably 0.12 to 0.18 mm. The shape of dimples is preferably circular in plane although the dimple shape is not critical. Non-circular dimples including ellipsoidal, oval, petaline, and polygonal planar shapes are acceptable.

Figure 4A:
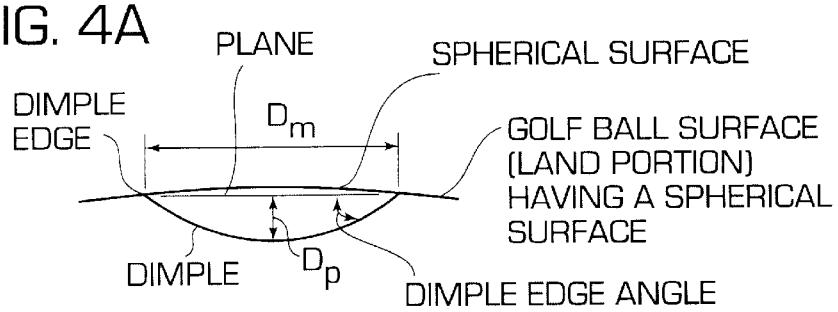
FIGS. 4A and 4B are schematic diagrams explaining the measurement of dimple volume.

A percent dimple surface area occupation as defined below is preferably 74 to 85%, more preferably 77 to 82%. The area of a dimple is given when it is projected on a plane. The dimple area is then represented by $\pi r^2$ when a dimple has a circular planar shape with a radius r and diameter $D_m$. The percent dimple surface area occupation is defined as the sum of areas of all dimples divided by the entire surface area of a phantom sphere given on the assumption that no dimples are on the golf ball surface. This is illustrated in FIG. 4A.

A percent dimple volume occupation as defined below is preferably 0.75 to 1.3%, more preferably 0.85 to 1.20%. The percent dimple volume occupation is defined as the sum of volumes of dimple spaces each defined below a plane circumscribed by the dimple edge divided by the entire volume of a phantom sphere given on the assumption that no dimples are on the golf ball surface.

Figure 4B:
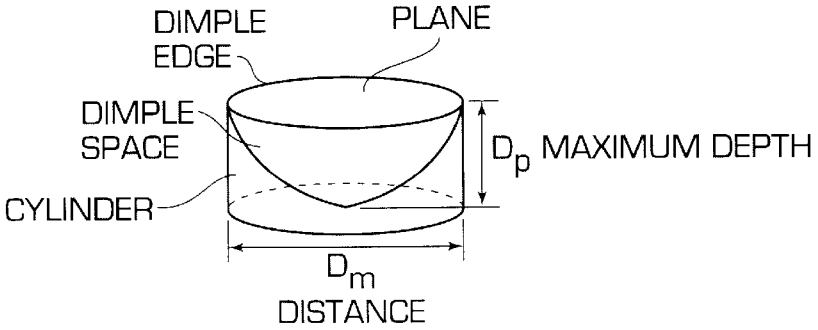

A $V_0$ value as defined below is preferably 0.3 to 0.7, more preferably 0.4 to 0.6. $V_0$ is obtained by averaging for all dimples the volume of one dimple space below a plane circumscribed by the dimple edge divided by the volume of a cylinder whose bottom is the plane having a diameter $D_m$ and whose height is the maximum depth $D_p$ of the dimple from the bottom. This is illustrated in FIG. 4B.

A dimple edge angle as defined below is preferably 4.0 to 17.0°, more preferably 5.0 to 13.0°. The dimple edge angle is an angle between a tangent at an arbitrary point on the edge of a dimple with respect to a phantom sphere given on the assumption that no dimples are on the golf ball surface and a tangent at the same point with respect to the actual ball surface.

Figure 5:
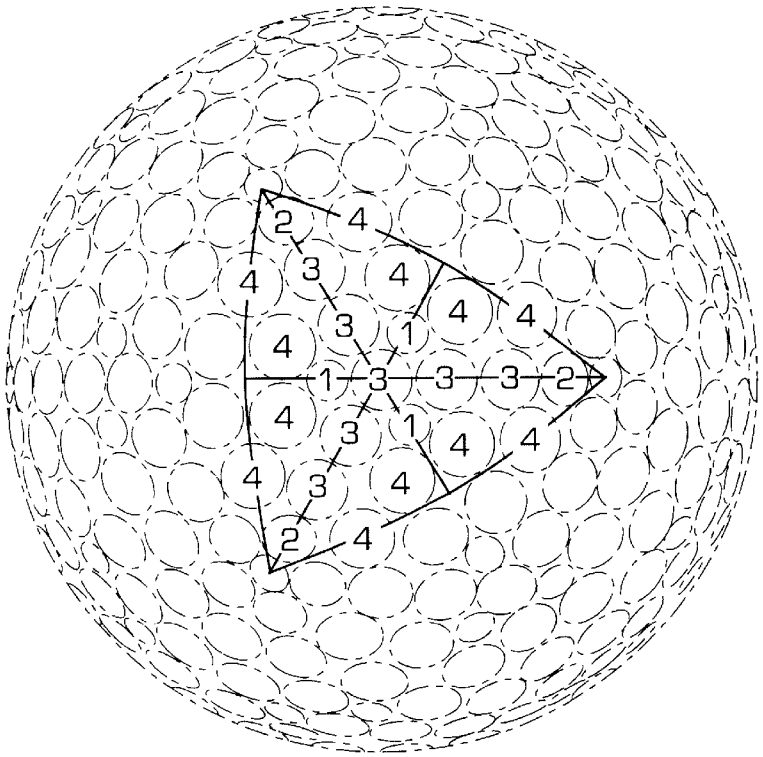
FIG. 5 is a view of a golf ball having an icosahedial dimple arrangement with 4 different types of dimples.

The dimple arrangement is not critical and may be selected from well-known arrangements, for example, regular octahedral, dodecahedral and icosahedral arrangements as well as symmetrical arrangements of equally dividing a hemisphere into 1 to 7 sections with respect to its center. The pattern formed on the ball surface by arranging dimples may be any of square, hexagon, pentagon, triangle and other patterns. FIG. 5 illustrates a typical pattern.

The golf ball to which the present invention pertains is not limited in structure and material. It can be prepared from well-known stock materials by conventional methods. The invention is applicable to either wound golf balls having a wound core enclosed with a cover or solid golf balls including one-piece golf balls and two- and multi-piece solid golf balls having a solid core enclosed with a cover. The cover stock used herein may be selected from ionomer resins and other thermoplastic resins which are commonly used in conventional golf balls.

The diameter and weight of the golf ball may be properly determined in accordance with the Rules of Golf.

EXAMPLE

Examples of the invention are given below by way of illustration and not by way of limitation.

Example and Comparative Example

A solid core having a diameter of 38.5 mm and a hardness corresponding to a distortion of 3.3 mm under an applied load of 100 kg was prepared from a well-known material by a conventional method. The core was enclosed with a well-known cover stock based on a commercial ionomer resin having a Shore D hardness of 57, obtaining a golf ball.

This golf ball and commercially available golf balls (Comparative Examples 1 and 2) had dimples with parameters shown in Table 1.

TABLE 1

| | | Comparative Example | |
|---|---|---|---|
| Dimple parameters | Example | 1 | 2 |
| Total number | 432 | 432 | 392 |
| Type | 4 | 5 | 3 |
| Arrangement | 8 | 20 | 8 |
| Average diameter | 3.6 mm | 2.8 mm | 4.2 mm |
| Average depth | 0.17 mm | 0.13 mm | 0.21 mm |
| Surface area occupation | 77% | 71% | 73% |
| Volume occupation | 0.90% | 0.71% | 1.40% |
| $V_0$ | 0.5 | 0.35 | 0.75 |
| Edge angle | 8.5° | 5.0° | 13.0° |

The lift and drag coefficients CL, CD, $CL_1$, $CL_2$, $CD_1$, and $CD_2$ of these golf balls were determined by the following method.

Figure 2:
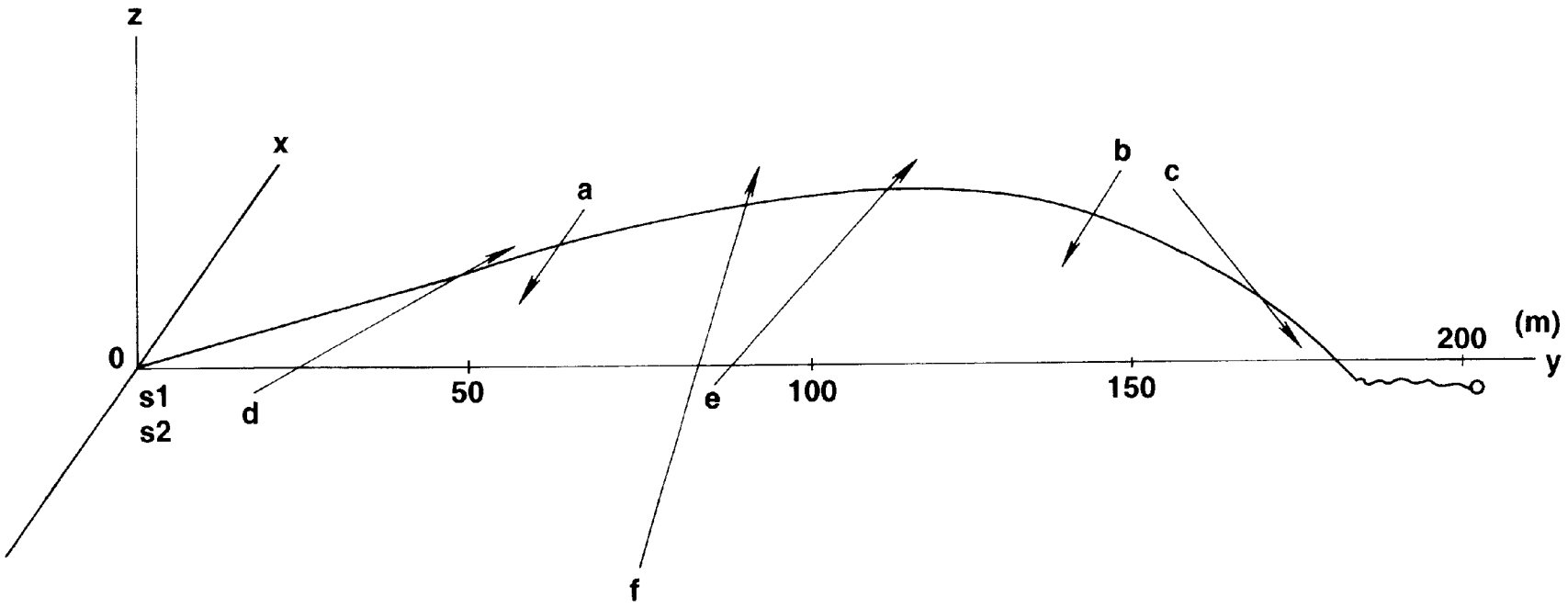
FIG. 2 shows an arrangement of video cameras located for determining coefficients of lift and drag

Using a swing robot (Miyamae K.K), the ball was hit with a driver (wood club #1, loft angle 10°) at a head speed of 45 m/sec. As shown in FIG. 2, the ball in flight was monitored by eight video cameras a, b, c, d, e, f, s1, and s2 for measuring initial conditions and spatial coordinates at predetermined points of time. By using a fiber sensor as a trigger, synchronizing the eight video cameras, recording data in a frame memory, and digitizing the positions, spatial coordinates of a golf ball trajectory after the lapse of a predetermined time (1, 2, 3, 4, and 5 seconds) were determined. Table 2 shows various conditions involved in the measurement, that is, ball properties (ball weight, diameter, and moment of inertia), ambient conditions (wind and air density), and initial conditions (initial velocity, launch angle, and spin) and Table 3 shows spatial coordinates data.

Figure 3:
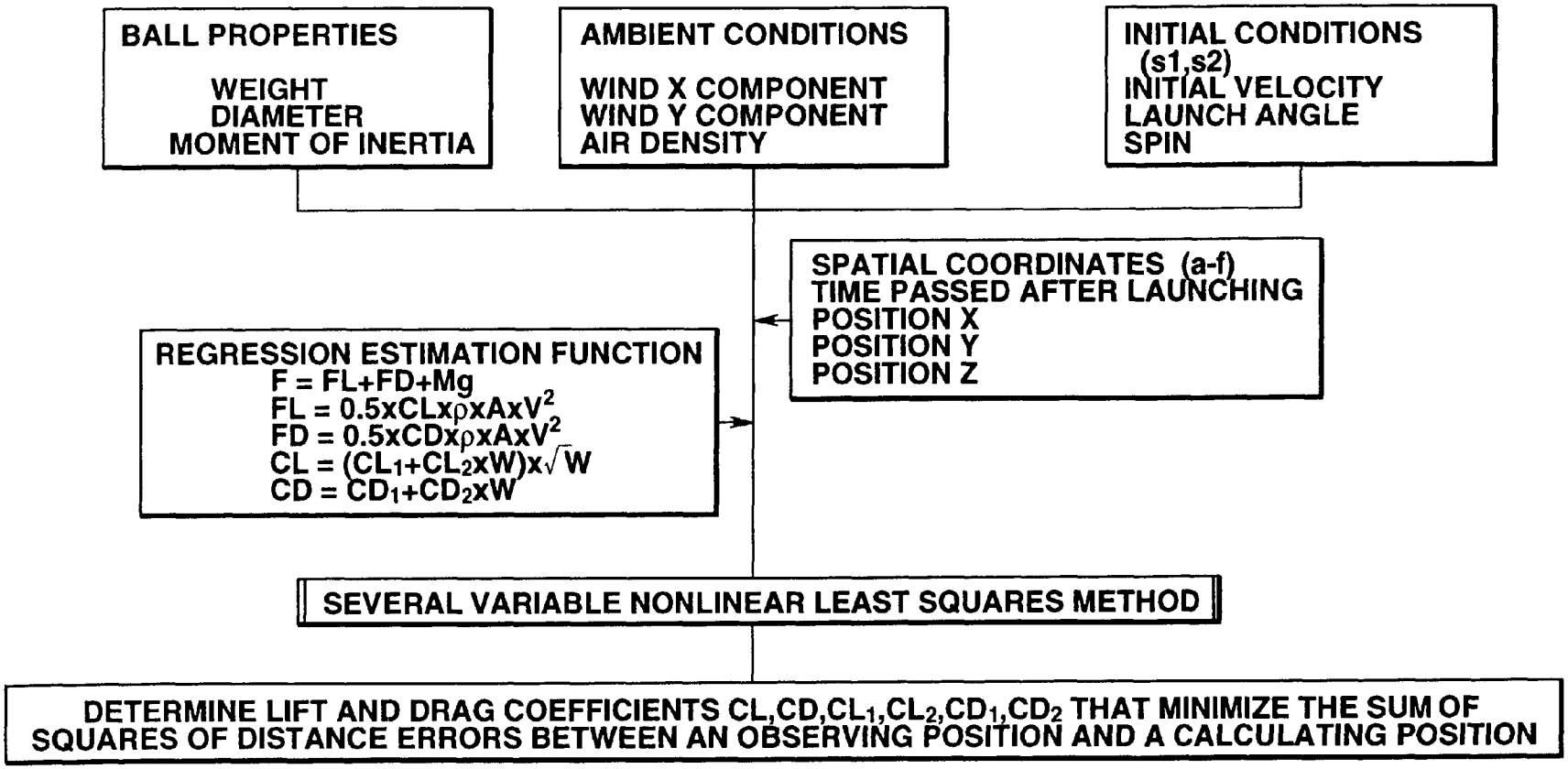
FIG. 3 is a flow chart illustrating analytical steps for determining lift and drag coefficients.

Then using these parameters, lift and drag coefficients CL, CD, $CL_1$, $CL_2$, $CD_1$, and $CD_2$ that minimize the sum of squares of errors between an observing position and a calculating position are determined according to the analysis algorithm shown in FIG. 3 by the several variable nonlinear least squares method capable of solving implicit representation. The results are shown in Table 4.

By substituting the thus determined lift and drag coefficients in the lift and drag functions, the ball trajectory was simulated to find that the simulated trajectory was coincident with the actual trajectory without an error.

TABLE 2

| | | |
|---|---|---|
| Ball properties | Diameter (mm) | 42.7 |
| | Weight (g) | 45.5 |
| | Moment of inertia (g-cm$^2$) | 78 |
| Ambient conditions | Wind X component (m/s) | 0 |
| | Wind Y component (m/s) | 0 |
| | Air density (kg/m$^3$) | 1.2 |
| Initial conditions | Initial velocity (m/s) | 65 |
| | Launch angle (°) | 10 |
| | Spin (rps) | 42 |

TABLE 3

| | | Time passed (sec.) | | | | |
|---|---|---|---|---|---|---|
| | | 1 | 2 | 3 | 4 | 5 |
| Example | Position Y (m) | 55.10 | 97.45 | 131.98 | 161.54 | 187.84 |
| | Position Z (m) | 10.46 | 17.32 | 19.11 | 15.35 | 6.03 |
| Comparative Example 1 | Position Y (m) | 54.38 | 95.32 | 128.29 | 156.33 | 181.20 |
| | Position Z (m) | 10.63 | 17.71 | 19.68 | 16.03 | 6.79 |
| Comparative Example 2 | Position Y (m) | 55.17 | 97.73 | 132.55 | 162.39 | 188.92 |
| | Position Z (m) | 10.06 | 16.00 | 16.63 | 11.60 | 1.01 |

TABLE 4

| | | Comparative Example | |
|---|---|---|---|
| | Example | 1 | 2 |
| CL | 0.163 | 0.174 | 0.155 |
| CD | 0.243 | 0.258 | 0.246 |
| CL/CD | 0.671 | 0.674 | 0.630 |
| $CL_1$ | 0.590 | 0.634 | 0.551 |
| $CD_1$ | 0.215 | 0.232 | 0.213 |
| $CL_2$ | −0.200 | −0.240 | −0.270 |
| $CD_2$ | 0.350 | 0.320 | 0.38 |
| $CL_1/CD_1$ | 2.744 | 2.733 | 2.587 |
| $CL_1 x CD_1$ | 0.127 | 0.147 | 0.117 |

Next, the golf balls whose lift and drag coefficients were determined as above were examined for flight distance by hitting the ball by means of a swing robot (Miyamae K.K.) with a driver (same as above) at a head speed of 45 m/sec. The results are shown in Table 5.

TABLE 5

| | Example | Comparative Example 1 | Comparative Example 2 |
|---|---|---|---|
| Carry (m) | 199.1 | 193.1 | 190.8 |
| Run (m) | 20.8 | 19.5 | 21.4 |
| Total (m) | 219.9 | 212.6 | 212.2 |

There has been described a dimpled golf ball wherein lift and drag coefficients as defined by a specific lift and drag functional model are optimized in a good balance. The ball is resistant to the wind, travels an increased distance and runs well.

Although some preferred embodiments have been described, many modifications and variations may be made thereto in the light of the above teachings. It is therefore to be understood that within the scope of the appended claims, the invention may be practiced otherwise than as specifically described.

It is claimed:

1. A golf ball having a plurality of dimples on it surface, said dimples including dimples which are different in diameter and/or depth, the total number of dimples is 392 to 432, and the golf ball has a percent dimple surface area occupation of 77 to 82%, a percent dimple volume occupation of 0.85 to 1.2%, an average dimple diameter of 2.5 to 4.5 mm (0.098 to 0.177 inches), an average dimple depth of 0.12 to 0.18 mm (0.005 to 0.007 inches), an average dimple $V_0$ value of 0.4 to 0.6, and a dimple edge angle of 4.0 to 17.0 degrees, wherein $CL_1$ is a first term of a lift coefficient and $CD_1$ is in the range of 0.175 to 0.220, $CL_1/CD_1$ is in the range of 2.60 to 3.30, and $CL_1 \times CD_1$ is in the range of 0.110 to 0.145.

2. A golf ball according to claim 1, wherein CD, is in the range of 0.185 to 0.210.

3. A golf ball according to claim 1, wherein $C_1/CD_1$ is in the range of 2.70 to 3.20.

4. A golf ball according to claim 1, wherein $CL_1 \times CD_1$ is in the range of 0.1115 to 0.135.

5. A golf ball according to claim 1, wherein CD is a total drag coefficient and CL is a total life coefficient, $CD_2$ is a second term of CD and $CL_2$ is a second term of $CL_1$ and $$CL=(CL_1+CL_2\times W)\sqrt{W}$$

$$CD=CD_1+CD_2\times W$$

where: W=(×W/√ where: W is the spin rate ratio (is the golf ball radius

W is the golf ball rotation angular velocity and $CL_2$ is in the range of −0.5 to 0.1

$CD_2$ is in the range of 0.1 to 0.5.

6. A golf ball according to claim 1, wherein said average dimple diameter is in the range of 3 to 4 mm (0.118 to 0.157 inches).

7. A golf ball having a plurality of dimples on its surface, said dimples including dimples which are different in diameter and/or depth, the total number of dimples is 392 to 432, and the golf ball has a percent dimple surface area occupation of 77 to 82%, a percent dimple volume occupation of 0.85 to 1.2%, an average dimple diameter of 2.5 to 4.5 mm (0.098 to 0.177 inches), an average dimple depth of 0.12 to 0.18 mm (0.005 to 0.007 inches), an average dimple $V_0$ value of 0.4 to 0.6, and a dimple edge angle of 4.0 to 17.0 degrees, wherein CL is a lift coefficient and CD is a drag coefficient, CL is in the range of 0.140 to 0.190, CD is in the range of 0.210 to 0.255, and CL/CD is in the range of 0.640 to 0.730 when the ball is in flight at a velocity of 65 m/s and a spin rate of 42 rps.

8. A golf ball according to claim 7, wherein CL is in the range of 0.15 to 0.185.

9. A golf ball according to claim 7, wherein CD is in the range of 0.220 to 0.250.

10. A golf ball according to claim 7, wherein CL/CD is in the range of 0.645 to 0.710.

11. A golf ball according to claim 7, wherein said average dimple diameter is in the range of 3 to 4 mm (0.118 to 0.157 inches).

* * * * *